United States Patent [19]

Devine

[11] 3,937,413

[45] Feb. 10, 1976

[54] DUAL FRAME ROCKER TRAILER

[76] Inventor: Joseph C. Devine, R.D. No. 1, Box 206, Grantville, Pa. 17028

[22] Filed: June 13, 1974

[21] Appl. No.: 478,929

[52] U.S. Cl...... 242/86.5 R; 214/505; 214/DIG. 4

[51] Int. Cl.[2] ..... B65H 75/00; B60P 1/04

[58] Field of Search..... 242/86.5 R, 85, 86.7, 86.8, 242/58, 58.6, 86.2; 254/166; 214/130 C, 334, 501, 505, DIG. 4

[56] References Cited

UNITED STATES PATENTS

| | | | |
|---|---|---|---|
| 391,497 | 10/1888 | Whitten | 242/86.5 R |
| 764,344 | 7/1904 | Buckelew | 242/86.5 R |
| 2,867,390 | 1/1959 | Anrig | 242/86.5 R |

*Primary Examiner*—Stanley N. Gilreath
*Assistant Examiner*—John M. Jillions
*Attorney, Agent, or Firm*—Philip D. Freedman

[57] ABSTRACT

A dual frame trailer for the carrying of cable reels is specifically advantageous in that it may carry large weights on a simple structure and may be manually loaded. The trailer structure comprises: (a) an axle between a set of wheels; (b) a main frame comprising: (1) a wishbone or yoke shaped structure comprising two rails parallel at their rear extremities and converging and joined at their forward extremities and normally being in an approximately horizontal plane; (2) stationary upright members depending upwardly from each of said rear extremities, each having (3) a reel bar mounting means attached at each upper end of the stationary upright support member, each support member further characterized as having an aperture for the accommodation of a pin at a point lower than reel bar support, and (4) braces each extending from the upper part of the reel bar support to said rail to form a triangle with said support and the main frame being pivotally attached at each rear extremity to opposite ends of the axle, and (c) a rocker frame comprising a pair of identically shaped frames lying in parallel vertical planes opposing one another and connected by means of bracing rails and each identically shaped frame pivotally attached at one angle to said axle in opposing relationship to one another at each end of said axle and each pair of identically shaped frames having reel bar support means at opposing ends of each identical frame, the upper most rail of each of the identical frames having an aperture for the accommodation of a pin for connecting to the main frame when the aperture is in alignment with a corresponding aperture in each of the support members of the main frame.

3 Claims, 9 Drawing Figures

22
23
16
11
18
15
14
34
37
27
36
39
24
12
42
44
47
51
49
33
55a
56a
29
31
32
57a
42b
52
48
46
50

52
42
46

15

11
12
14
15
16
18
22
23
24
27
29
34
36
37
39
39
42
42b
44
46
55a
56a
57a

DUAL FRAME ROCKER TRAILER

As pointed out by Garnett, U.S. Pat. No. 3,379,392, wire rope, power transmission lines, telephone cables and like cables are often of a substantial length and are ordinarily wound upon flanged spoollike reels which may be quite large and heavy. When necessary to pay out cable, the reel is usually mounted and supported upon a horizontal shaft so it may rotate as the cable is pulled therefrom. For field use, a wheeled trailer may be adapted to carry and support a reel upon a shaft, so that the reel will not have to be taken off the trailer when the cable is to be paid from it.

Similarly, large reels are used for stringing the signal carrying and support cables in the cable television industry and various problems encountered in other industries are similarly encountered in this industry. In addition, there are various difficulties that arise related to the transportation and support of cable reels that are unique to the television cable industry. A suitable trailer for transportation and support of cable reels must be able to carry reels of varying diameters and weights and must be able to do so in a balanced relationship. Furthermore, the trailer because of certain governmental regulations must be of a restricted length and width. Finally, and most importantly, a suitable trailer must be easily loadable, preferably manually loadable.

The present invention is directed to a trailer structure for the carrying of cable reels providing for secure reel mounting while in transport on the trailer and being a relatively simple structure and yet being surprisingly effective for the handling of reels in transportation, in stringing, and particularly in loading.

J. Van Vorst, U.S. Pat. No. 1,895,217, is an early patent relating to a reel carrier having two longitudinally spaced upwardly projecting lugs setting on a wheeled wagon-type structure. Reel shafts may set on the top end of the projecting lugs. I. G. Stemm, et al., U.S. Pat. No. 2,635,827, relates to a reel sled for supporting a plurality of reels having a brake means to control the reel location. Haskell, et al., U.S. Pat. No. 2,703,218 is concerned with the prelashing of a cable through its supporting strand and is directed to a method and means which comtemplates the feeding of the cable and the strand from suitable reels, lashing a wire around the cable as it is pulled up into position on the pole line, and applying suitable back tension to the cable and strand during the operation to assure the right amount of tension and sag in the completed run. The patent does show an apparatus characterized by a single chassis for the carrying of a single reel and having certain tension applying means. T. R. Hall, U.S. Pat. No. 2,780,419, similarly shows a single chassis frame for the carrying of a single reel having a hydraulic brake means and a hydraulic lift means. The necessity of having an hydraulic lift means emphasizes one advantage of the present invention and points out one of the problems existing in the cable reel art; that is, the problem of loading large and heavy reels onto simple structures of the type contemplated. The Hall patent solves the problem by providing a hydraulic lift mechanism. The present invention is particularly advantageous in that the subject trailer may be manually loaded as hereinafter described. Anrig, U.S. Pat. No. 2,867,390, shows a spool trailer having a carrier member for the spools and means operatively connected to the same for raising and lowering reels on the carrier members. Fleischer, et al., U.S. Pat. No. 3,063,584 simiarly shows a reel loading and unloading means. Garnett, U.S. Pat. No. 3,073,574, teaches a piece of equipment used for wire stringing that permits rope, as it is played out, to be moved back and forth parallel to the reel shaft to assure proper stringing of the line. It should be noted that many of the features shown in these described patents are incorporable into the present invention without changing the essential novel features of this invention. Garnett, U.S. Pat. No. 3,379,392, teaches a single yoke shaped main frame having a certain type of rocker beam pivotally connected at each side of the main frame to provide for the raising and lowering of the reelward end of the trailer. Parsen, U.S. Pat. No. 3,764,031, describes a trailer assembly that may be converted for carrying other types of mobile equipment.

The present invention relates to a unique dual independent frame trailer structure for carrying cable reels. The structure comprises: (a) an axle between a set of wheels; (b) a main frame comprising: (1) a wishbone or yoke shaped structure comprising two rails parallel at their rear extremities and converging and joined at their forward extremities and normally being in an approximately horizontal plane; (2) stationary upright members depending upwardly from each of said rear extremities, each having (3) a reel bar mounting means attached at each upper end of the stationary upright support member, each support member further characterized as having an aperture for the accommodation of a pin at a point lower than reel bar support, and (4) braces each extending from the upper part of the reel bar support to said rail to form a triangle with said support and the main frame being pivotally attached at each rear extremity to opposite ends of the axle, and (c) a rocker frame comprising a pair of identically shaped frames lying in parallel vertical planes opposing one another and connected by means of bracing rails and each identically shaped frame pivotally attached at one angle to said axle in opposing relationship to one another at each end of said axle and each pair of identically shaped frames having reel bar support means at opposing ends of each identical frame, the upper most rail of each of the identical frames having an aperture for the accommodation of a pin for connecting to the main frame when the aperture is in alignment with a corresponding aperture in each of the support members of the main frame. The dual independent frame trailer structure is further characterized in that when the main and rocker frames are disconnected and both are tipped forward for the receiving of a cable reel, the reel bar support means of each stationary upright support member may be level with each of the uppermost rails of the rocker frame to facilitate loading of reels onto said trailer structure.

The foregoing described and additional features of the trailer of this invention will become apparent from the description which follows taken in connection with the accompanying drawings in which:

FIGS. 3, 4, 5 and 6 are side elevational views of a trailer similar to that of FIG. 1. These Figures show the sequence of loading the trailer of the invention.

FIG. 8 is an enlarged sectional detail view of the axle connection between the main frame and the wheels of the trailer.

FIG. 9 is a detail view of one of the forward mounting brackets.

Figure 1:
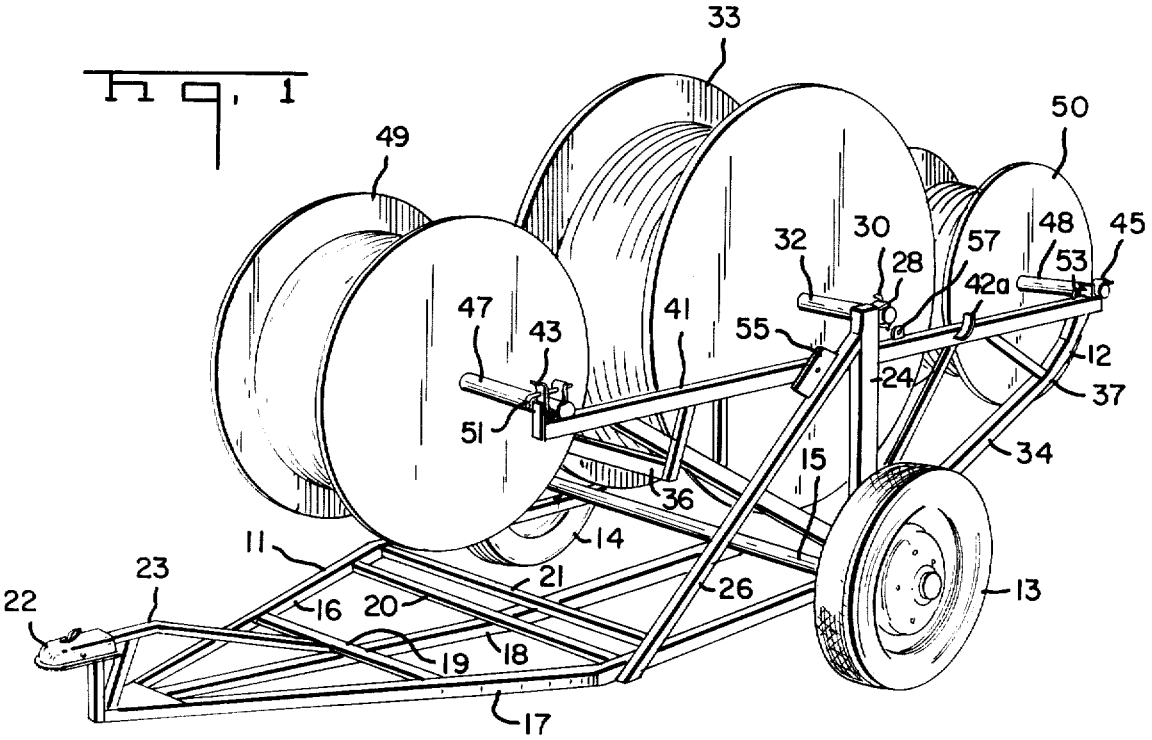
FIG. 1 is a perspective view of the dual indepedent frame trailer structure illustrating the novel features of this invention. The Figure shows the rocker frame as two substnatially triangular shaped frames.
Figure 2:
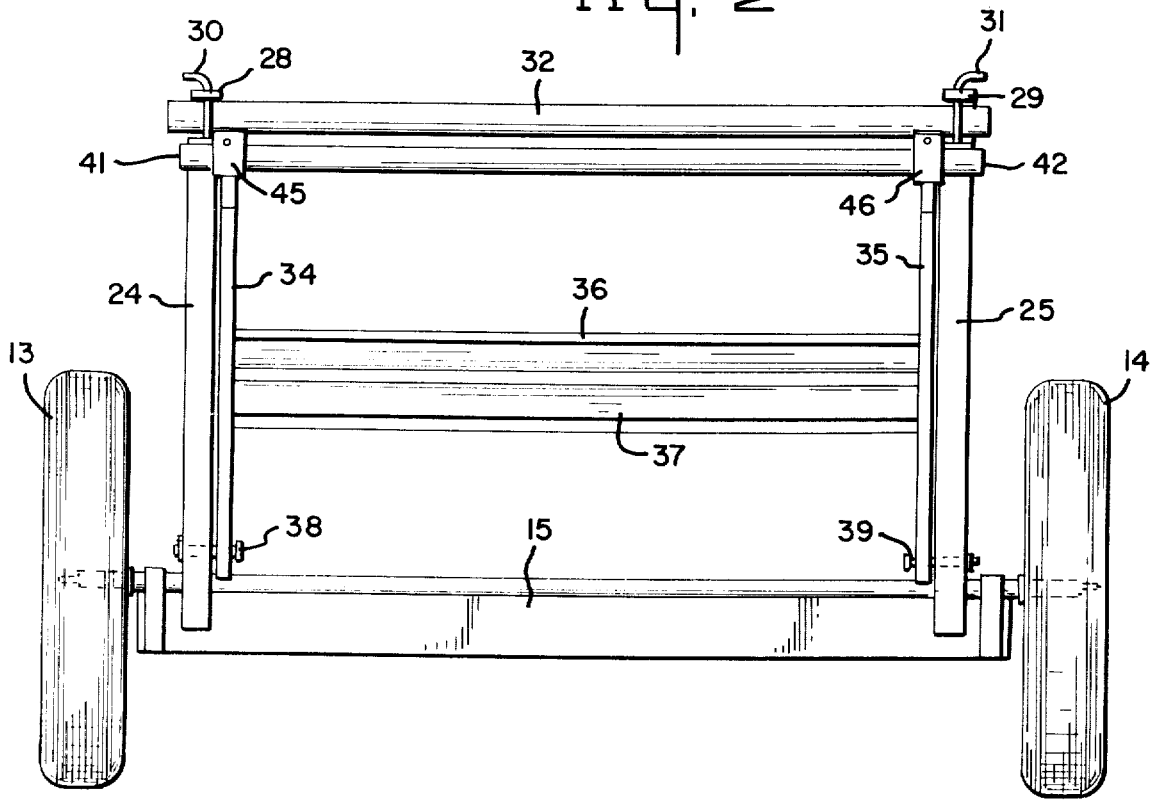
FIG. 2 is a rear elevational view of the trailer of FIG. 1.
Figure 7:
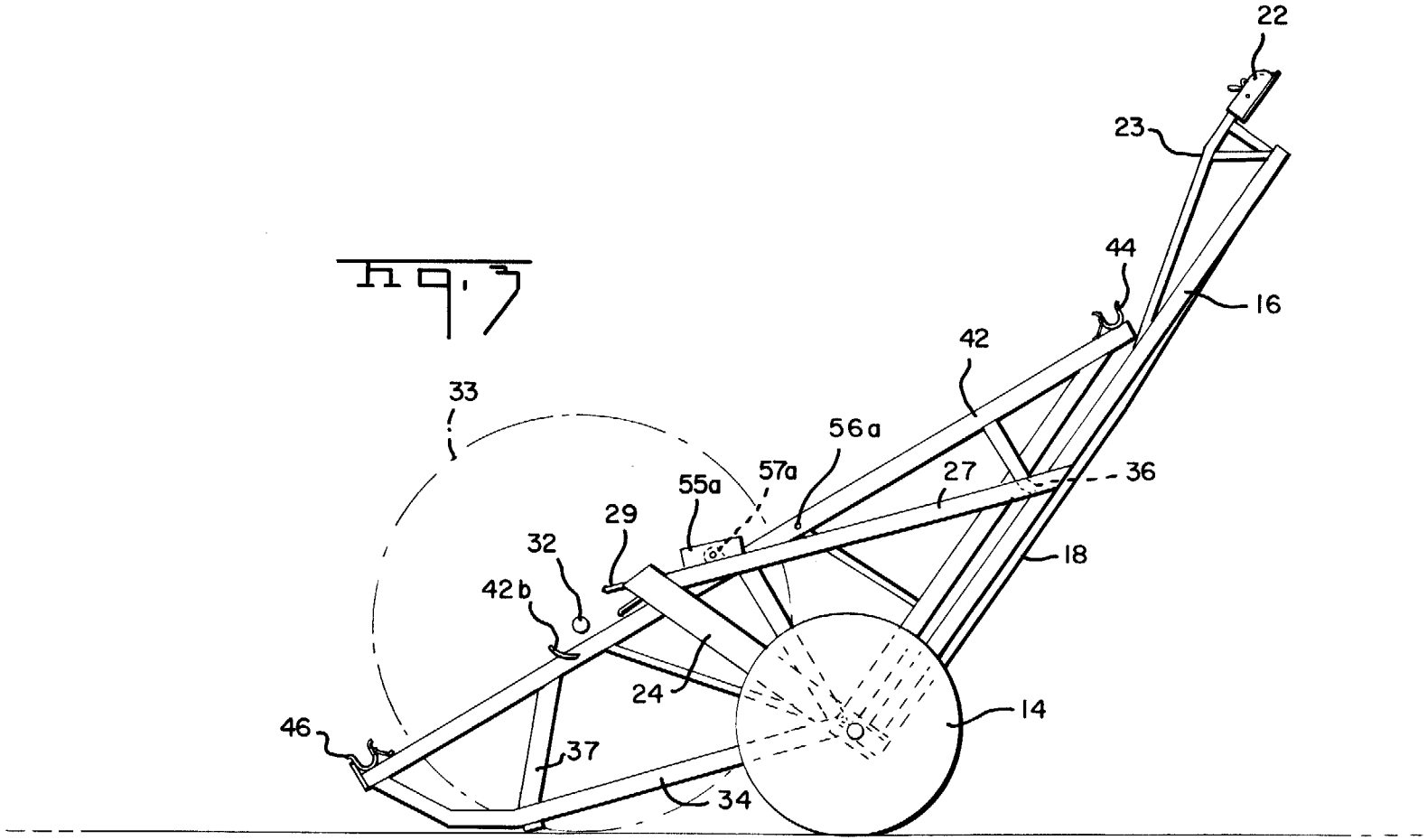
FIG. 7 is a sectional view taken on a side elevation of the two independent frames that make up the trailer of the invention.

The trailers of the figures are exemplary of the reel carrying units of the present invention. To this end they include a first main frame 11 and a rocker frame 12 which will be described infra and a set of wheels 13 and 14 attached to a cross brace member 15 to form the axle of the wheels. The main frame 11 may be pivoted around the axis formed by the cross brace member 15. Further, the main frame is in the shape of a yoke or wishbone and comprises two rails 16 and 17, parallel at their rear extremities and converging and joined at their forward extremities. Longitudinal brace member 18 runs from the point of convergence to cross brace member 15. The frame further comprises cross brace members 19, 20 and 21 and hitch 22 supported on a hitch brace structure 23. Stationary upright members 24 and 25 depend upwardly from each of the rear extremities and are supported by diagonal braces 26 and 27. Reel bar mounting brackets 28 and 29 are horizontally disposed and have pin means 30 and 31 for securing the bar 32 of mounted reel 33.

The second rocker frame 12 comprises a pair of substantially triangular or otherwise shaped frames 34 and 35 each respectively braced by ground stand support members 36 and 37 and structural brace members not numbered. Each triangular frame in concert with the other is pivotally attached to the first frame by means of pins 38 and 39. The frames are described as substantially triangular in shape but they may be of any shape so long as they form a frame for carrying reels at opposing ends on either side of the pivotal attachment to the first frame. The top rails 41 and 42 of each triangular frame may extend beyond the point of intersection with the other rails forming the frame as shown. Each top rail has a hook indicated 42a and 42b and a U-shaped reel bar mounting bracket at or near each end of the rail and indicated 43, 44, 45 and 46 in the drawings. These brackets are vertically deposed and are used for carrying bars 47 and 48 of mounted reels 49 and 50. The bars 47 and 48 are secured to the mounting brackets by means of pins 51, 52, 53 and 54 (not shown).

In one embodiment of the present invention as shown n the drawings, the first frame is provided with pin ecuring means 55 and 55a which may be aligned with pertures 56 (not shown), 56a and 57 (not shown) and 57a on the second frame so that one frame may be ecured to the other in various positions for loading as vill be described.

Figure 4:
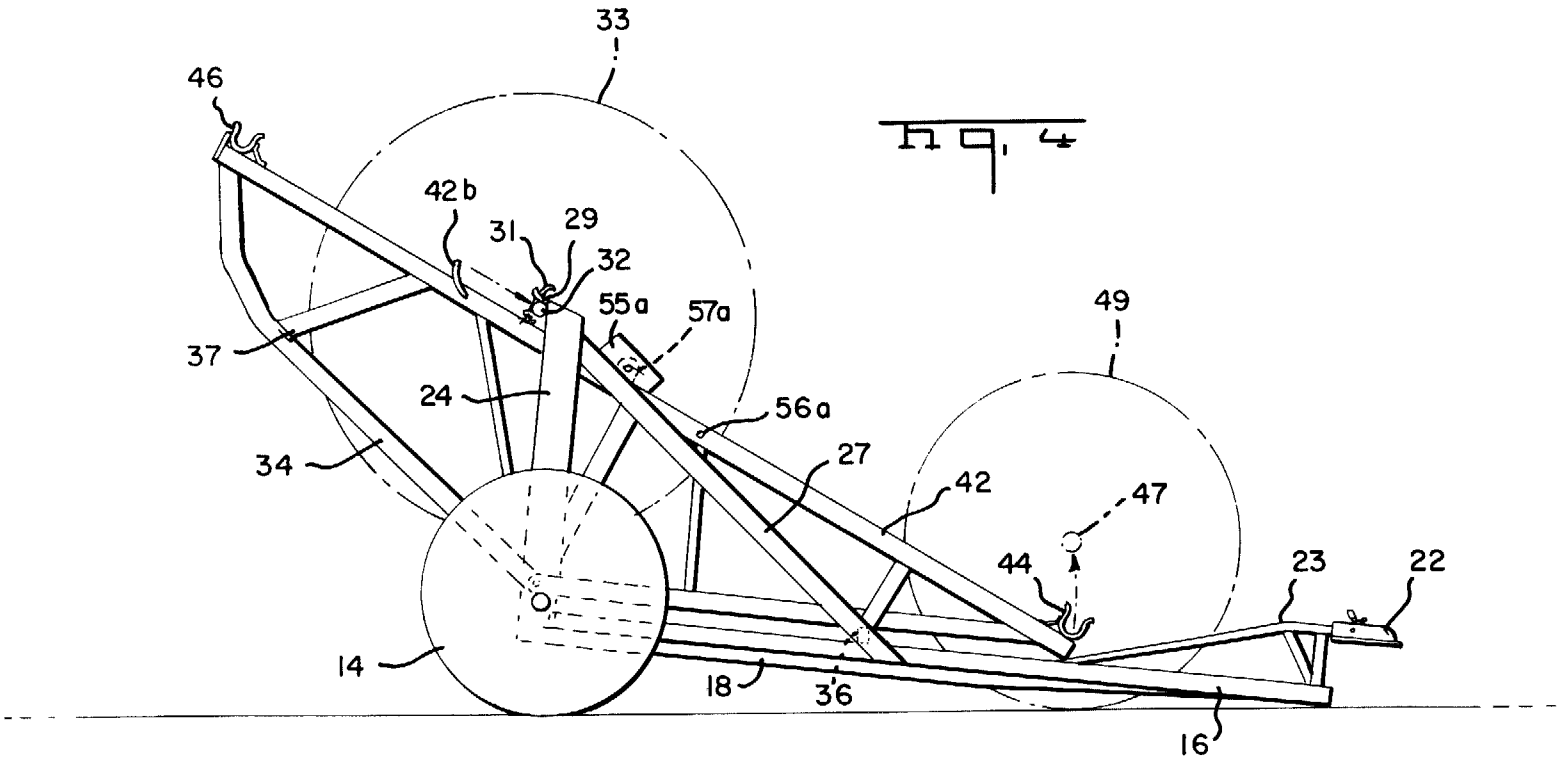
Figure 7:
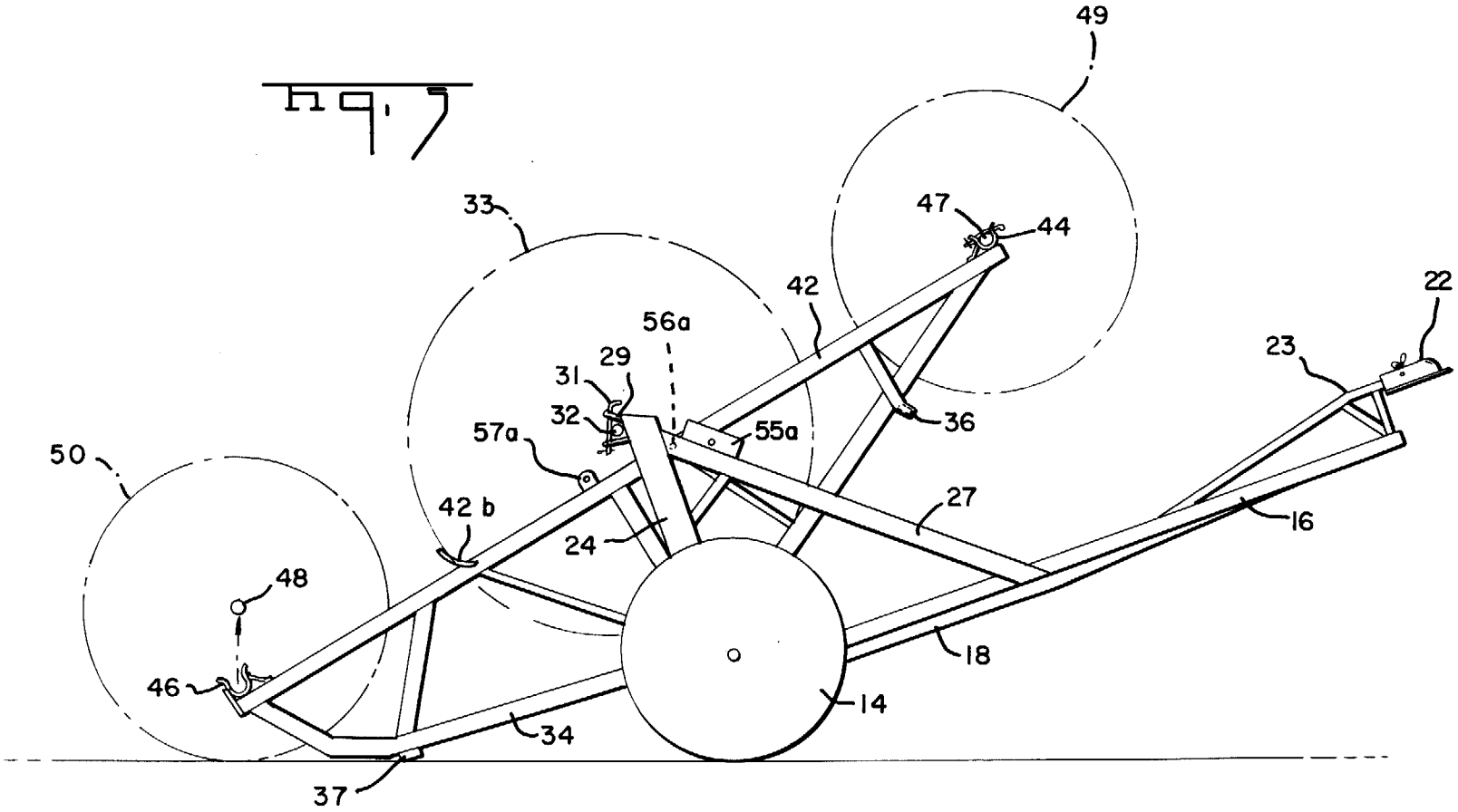

The following description is exemplary of the operaion of trailers of the present invention. With reference o the drawings, particularly FIGS. 3, 4 and 5, a center eel 33 is first loaded by tipping the rocker frame 12 earward and locking with the main frame 11 by means f pins through securing means 55 and **55*a* and apertures 57 and 57*a*. The entire trailer is then tilted rearvard until the hooks 42*a* and 42*b* clear the bar of the eel to be loaded and the rocker frame 12 is resting on round stand support member 37 as shown in FIG. 3. he trailer is then tilted forward to catch the reel bar by means of hooks 42*a* and 42*b* and then further tilted forward so that the reel rolls up the top rails 41 and 42 of the rocker frame 12 to nestle in the reel bar mounting bracket 28 and 29. The reel is secured to the brackets 28 and 29 by means of pin members 30 and 31. The entire trailer is then tilted forward till it rests on the yokeshaped section of the main frame 11.**

The locking pins are withdrawn from securing means 55 and 56 and apertures **55*a* and 56*a* and the rocker frame 12 is swung out of the way and the second reel 49 is rolled in on the forward section of the main frame 11 and positioned so as to allow the rocker to be tilted forward and down to "scoop up" reel 49. Reel bar 47 is positioned with the reel bar mounting brackets 43 and 44. See FIG. 4. The rocker frame 12 is raised slightly so that reel bar 47 fits within the brackets 43 and 44 and may be secured thereto by pins 51 and 52. In this position the rocker frame 12 may again be locked with the main frame 11 by means of pins through securing means 55 and 55*a* and apertures 57 and 57*a*.**

Figures 6, 7:
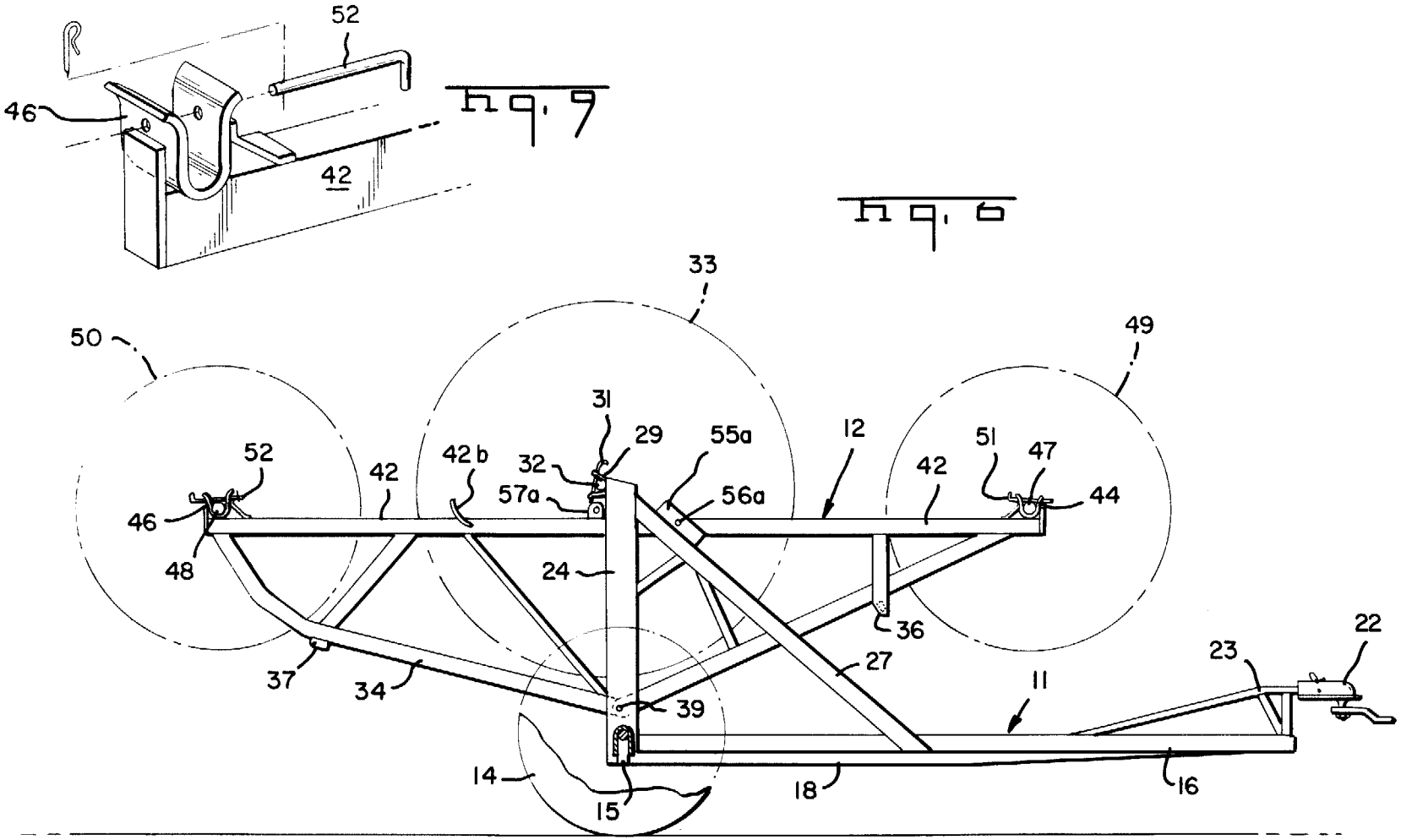
Figures 6, 7:
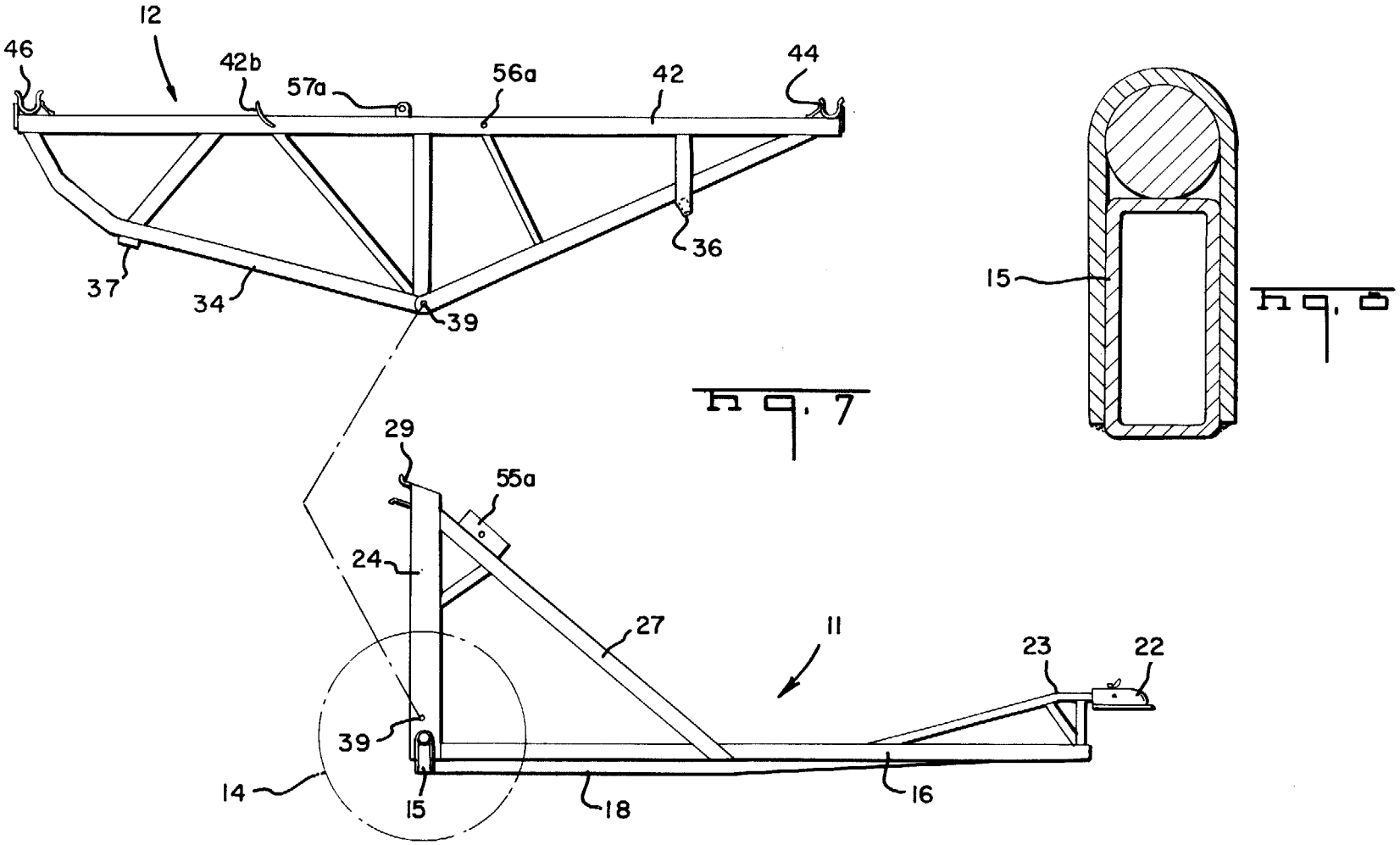

At this point, the reel 50 is rolled into position near the rear of the already loaded center reel 33 taking care to center the reel 50 in the space available between the rearward portion of the elevated top rails 41 and 42 of the rocker frame 12. The entire trailer is then tilted rearward by raising the front portion of the main frame so that the rear mounting brackets 45 and 46 pass beneath the bar 48 of reel 50. See FIG. 5. The forward section of the trailer is lowered until the brackets 45 and 46 engage the bar 48 which is secured thereto by means of pins 53 and 54. The frames are disengaged from one another at 55 and **55*a* and 57 and 57*a* and the rocker frame is tilted forward until locking pins can be inserted through 55 and 55*a* and 56 and 56*a* to secure the frames to one another so that the entire trailer may be rocked to a position where the top rails 41 and 42 of the rocker frame are substantially horizontal and the stationary upright members 24 and 25 are substantially vertical and perpendicular to the top rails 41 and 42. See FIG. 6. The entire unit in this position is 17** balanced with only a slight weight bias forward. It has been found that so loaded the trailer may be easily handled and may be towed without difficulty.

In summary the advantages of the trailer of the present invention are as follows:

Reels may be loaded from the ground level by the trailer itself, being manipulated by manpower only and not requiring additional mechanical devices.

The loaded trailer may be maintained in a balanced condition of equal weight distribution so as to be stable during towing as well as in static positions on the job site.

The trailer overcomes the problem of extreme difference in diameters and widths of reels that must be loaded.

Simplicity in construction and overall lightness of the trailer enables greater payload to be carried within weight limitations for licensing purposes.

The trailer may be constructed of square and rectangular tubing of varying cross sections of wall thicknesses. All members of the trailer may be stressed and gusseted to provide extra strength needed for the cantilever reel spindle placements. Heavy wall reel spindles may be located in deep yokes provided with safety locking pins. Rings may be welded on the reel spindles to control side movement and to locate the reels laterally.

What is claimed is:

1. A dual frame rocker trailer for the carrying of cable reels supported by reel bars, of varying size and weight comprising:

A. a main frame having an attached set of wheels and comprising; (i) a yoke-shaped structure comprising two rails parallel at their rear extremities and converging and joined at their forward extremities and being in a substantially horizontal plane; (ii) stationary upright members depending upwardly from each of said rear extremities, each having (iii) a reel bar mounting means attached at each upper end of the stationary upright support member; and B. a rocker frame comprising a pair of connected, substantially triangular-shaped rail frames lying in parallel vertical planes and opposing and parallel to one another; pin means pivotally connecting an angled portion of each of said triangular -shaped rail frames to said main frame at or near the locations where said stationary upright members depend upwardly from each of said extremities, and each of said substantially triangular-shaped rail frames having reel bar support means at opposing ends and further characterized in that each stationary upright support member of the main frame has an aperture at a point lower than the reel bar support, and the rail opposite said angled portion of pivotal attachment of each of the substantially triangularshaped rail frames further characterized as having a plurality of apertures; said dual frame rocker trailer further including pins for attaching said rocker frame to said main frame in a plurality of positions by passing said pin through each of the apertures of the upright support members and through an aperture of the rail opposite the angled portion of pivotal attachment of the substantially triangular-shaped rail frame, and said main frame further may be disconnected from said rocker frame and said rocker frame tipped forward or backward so that the reel bar mounting means at each upper end of said stationary upright support member becomes aligned in a level position with a respective rail opposite the angled portion of pivotal attachment of said rocker frame for the receiving of a cable reel bar in loading.

2. The trailer of claim 1 wherein said main frame further comprises braces extending from the upper part of said upright support member to said rails of said yoke-shaped structure.

3. The trailer of claim 1 wherein said reel bar mounting means located at the upper end of said stationary upright support members are disposed substantially horizontal for the receiving of the bar of a cable reel in loading.

* * * * *